US009784521B2

(12) United States Patent
Bartak

(10) Patent No.: US 9,784,521 B2
(45) Date of Patent: Oct. 10, 2017

(54) BIPOD FIREARM SUPPORT

(71) Applicant: Swagger, LLC, Grand Island, NE (US)

(72) Inventor: Thomas Bartak, Bloomfield, NE (US)

(73) Assignee: SWAGGER, LLC, Grand Island, NE (US)

( * ) Notice: Subject to any disclaimer, the term of this patent is extended or adjusted under 35 U.S.C. 154(b) by 0 days.

(21) Appl. No.: 15/041,009

(22) Filed: Feb. 10, 2016

(65) Prior Publication Data

US 2016/0238336 A1 Aug. 18, 2016

Related U.S. Application Data

(60) Provisional application No. 62/115,768, filed on Feb. 13, 2015.

(51) Int. Cl.
*F41A 23/10* (2006.01)

(52) U.S. Cl.
CPC ..... *F41A 23/10* (2013.01)

(58) Field of Classification Search
CPC ..... F41A 23/08; F41A 23/10; F41A 23/16; F41C 23/16; F41C 23/22
USPC ..... 42/94, 90; 89/37.04; 248/163.1
See application file for complete search history.

(56) References Cited

U.S. PATENT DOCUMENTS 3,327,422 A * 6/1967 Harris ..... F41A 23/08 42/94
4,776,124 A 10/1988 Clifton
5,029,407 A * 7/1991 Kirkpatrick ..... F41A 23/10 42/94
6,062,527 A * 5/2000 Nygren, Jr. ..... B64G 1/222 248/591
6,289,622 B1 * 9/2001 Desch, Jr. ..... F41A 23/10 42/94
7,677,233 B2 3/2010 Bednar
7,770,320 B1 8/2010 Bartak
7,992,339 B2 * 8/2011 Hinds, Jr. ..... F41A 23/10 42/94
9,121,665 B2 9/2015 Hinds
2008/0307689 A1 * 12/2008 Dotson ..... F41A 23/06 42/94

(Continued)

FOREIGN PATENT DOCUMENTS

WO WO 2009009663 A2 * 1/2009 ..... F41A 23/10
WO WO 2012009427 A2 * 1/2012 ..... F41A 23/04

*Primary Examiner* — Jonathan C Weber
(74) *Attorney, Agent, or Firm* — Bennet K. Langlotz; Langlotz Patent & Trademark Works, Inc.

(57) ABSTRACT

A bipod firearm support has a body defining a first bore and a second bore, a first offset bore segment associated with the first bore, and angularly offset with respect to the first bore, a second offset bore segment associated with the second bore, and angularly offset with respect to the second bore, a first elongated leg adapted to be closely and removably received in the first bore for stowage, a second elongated leg closely and removably received in the second bore for stowage, each of the first and second legs having a base segment sized to be closely received in the associated offset bore segment for deployment, and each of the first and second legs having an elongated leg portion connected to the base segment by way of a connection facility that enables angular flexure of each elongated leg portion with respect to the base segment.

12 Claims, 15 Drawing Sheets

(56) References Cited

U.S. PATENT DOCUMENTS

| | | | | |
|---|---|---|---|---|
| 2010/0192449 | A1* | 8/2010 | Hinds, Jr. | F41A 23/10 42/94 |
| 2011/0265366 | A1* | 11/2011 | Hinds, Jr. | F41A 23/08 42/94 |
| 2012/0186126 | A1* | 7/2012 | Bartak | F41G 11/003 42/94 |
| 2013/0174463 | A1* | 7/2013 | Hinds | F41A 23/04 42/94 |

* cited by examiner

BIPOD FIREARM SUPPORT

CROSS-REFERENCE TO RELATED APPLICATION

This application claims the benefit of U.S. Provisional Patent Application No. 62/115,768 filed on Feb. 13, 2015, entitled "BIPOD FIREARM SUPPORT," which is hereby incorporated by reference in its entirety for all that is taught and disclosed therein.

FIELD OF THE INVENTION

The present invention relates to firearms and crossbows, and more particularly to a bipod firearm support that can function as a stand, a brace against the user's body, or a handle.

BACKGROUND OF THE INVENTION

Bipod supports have long been used to support the forward end or muzzle of a rifle or shotgun, or a crossbow, during the firing thereof in an effort to "steady" or "stabilize" the weapon to increase the shooter's accuracy. The bipod supports are also useful to support the muzzle of the rifle above the ground or other supporting surface during periods when the rifle is not being fired or is being cleaned. Some bipods have legs of a fixed length, while other bipods have length adjustable legs. If the legs of the bipod have fixed lengths, the firearm will be supported at a predetermined height above the ground. Thus, the shooter cannot adjust the height of the firearm. If the legs of the bipod are length adjustable, the height of the firearm above the ground can only be changed by manually adjusting the lengths of both legs of the bipod. Further, if the shooter is shooting on a side hill, the firearm will be canted, which not only makes it difficult for the shooter to sight the firearm, but the canting of the firearm will affect the accuracy thereof.

If the bipod has adjustable length legs, and the bipod is used on a side hill, the firearm will be canted unless one of the legs of the bipod is shortened or lengthened to maintain the firearm in a non-canted position. The fact that one of the legs must be length adjusted may result in the shooter missing an opportunity to shoot a game animal, enemy, or other target.

Therefore, a need exists for a new and improved bipod firearm support that enables the individual legs of the bipod to be pivotally moved with respect to the support to compensate for a side hill situation, an uphill situation or a downhill situation, or to lower the support. In this regard, the various embodiments of the present invention substantially fulfill at least some of these needs. In this respect, the bipod firearm support according to the present invention substantially departs from the conventional concepts and designs of the prior art, and in doing so provides an apparatus primarily developed for the purpose of enabling the individual legs of the bipod to be pivotally moved with respect to the support to compensate for a side hill situation, an uphill situation or a downhill situation, or to lower the support.

SUMMARY OF THE INVENTION

The present invention provides an improved bipod firearm support, and overcomes the above-mentioned disadvantages and drawbacks of the prior art. As such, the general purpose of the present invention, which will be described subsequently in greater detail, is to provide an improved bipod firearm support that has all the advantages of the prior art mentioned above.

To attain this, the preferred embodiment of the present invention essentially comprises a body defining a first bore and a second bore, a first offset bore segment associated with the first bore, and angularly offset with respect to the first bore, a second offset bore segment associated with the second bore, and angularly offset with respect to the second bore, a first elongated leg adapted to be closely and removably received in the first bore for stowage, a second elongated leg closely and removably received in the second bore for stowage, each of the first and second legs having a base segment sized to be closely received in the associated offset bore segment for deployment, and each of the first and second legs having an elongated leg portion connected to the base segment by way of a connection facility that enables angular flexure of each elongated leg portion with respect to the base segment. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
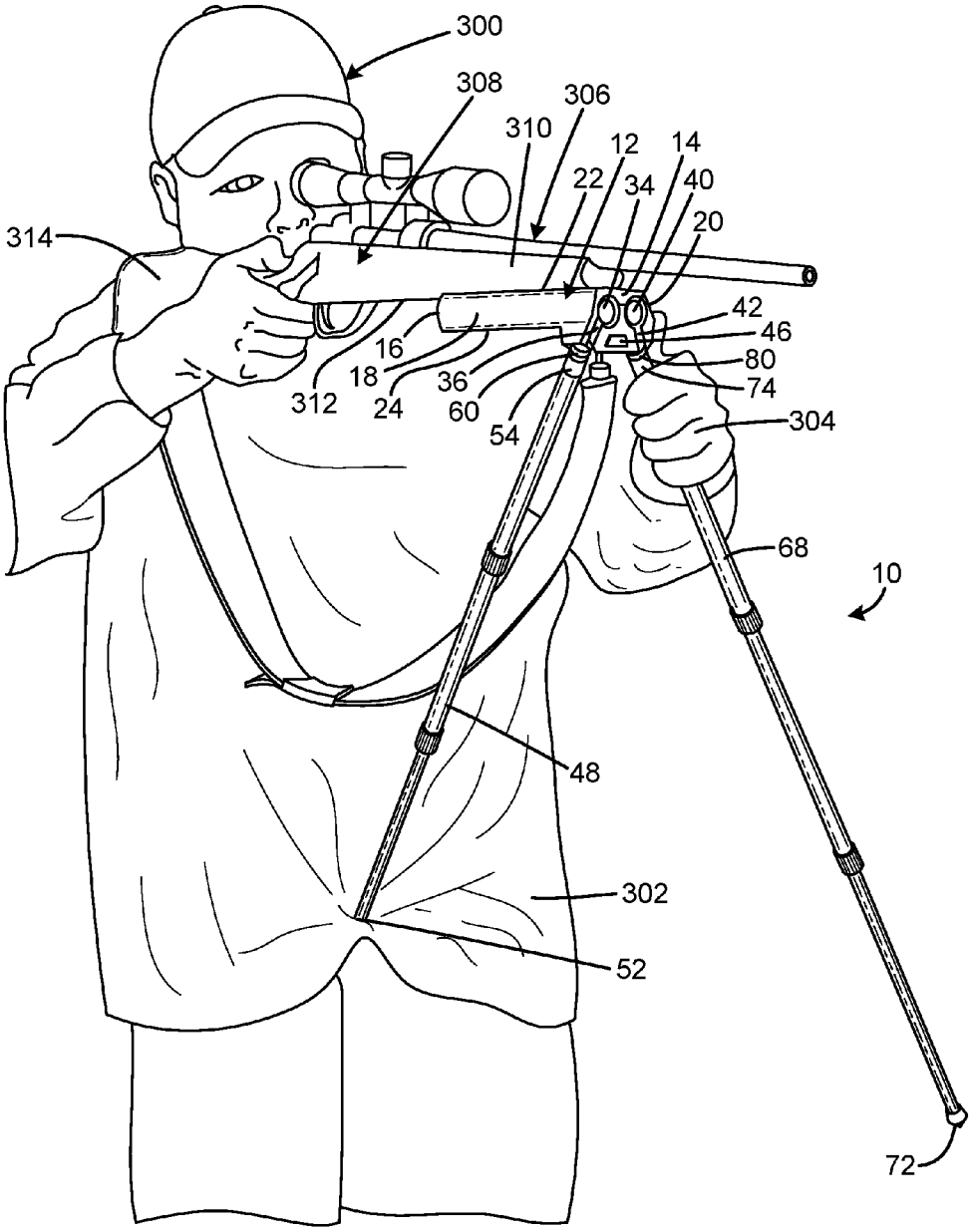
FIG. 1 is a front perspective view of the current embodiment of the bipod firearm support constructed in accordance with the principles of the present invention in use supporting a rifle.

An embodiment of the bipod firearm support of the present invention is shown and generally designated by the reference numeral 10.

FIGS. 1-9 illustrates the improved bipod firearm support 10 of the present invention. More particularly, in FIG. 1 the bipod firearm support is depicted in use by a shooter 300 supporting a firearm 306, which is a rifle in the current embodiment, but can also be a shotgun, crossbow, or an optical instrument such as a monocular. The rifle has a forend 310 with a bottom 312 and a butt 314. The bipod firearm support has a body 12 with a front 14, rear 16, right side 18, left side 20, top 22, and bottom 24. The front of the body defines a right bore 34 and a left bore 40 that are parallel to one another in the current embodiment. However, the right and left bore can also be at an angle to one another in alternative embodiments to accommodate alternative support leg designs and/or to avoid the bore of the attached firearm. A right bore segment 38 and a left bore segment 44 are in communication with, perpendicular to, and angularly offset with respect to their respective bores in the current embodiment. However, the bore segments can also be at angles other than 90° to their respective bores in alternative embodiments. A right slot 36 and a left slot 42 are in communication with their respective bores and bore segments. A button 46 actuates latches located within the right and left bore segments, which will be discussed in detail in the description of FIGS. 13-15.

The right support leg 48 has a top 50, a bottom 52, and a plurality of elongated segments telescopically interacting with each other to provide an adjustable length. The top of the right support leg is connected to the bottom 58 of a right end cap 54. The top 56 of the right end cap is connected to a connection facility that enables angular flexure of the right support leg, which is a right coil spring 60 that is a cylindrical member having a diameter substantially the same as that of the right support leg in the current embodiment. The right coil spring is also connected to the bottom 66 of a right base segment 62. The right coil spring returns the right support leg and right end cap to axial alignment with the right base segment in the absence of a deflecting force. The top 64 of the right base segment receives one end 92 of right elastic cord 88.

The left support leg 68 has a top 70, a bottom 72, and a plurality of elongated segments telescopically interacting with each other to provide an adjustable length. The top of the left support leg is connected to the bottom 78 of a left end cap 74. The top 76 of the left end cap is connected to a connection facility that enables angular flexure of the left support leg, which is a left coil spring 80 that is a cylindrical member having a diameter substantially the same as that of the left support leg in the current embodiment. The left coil spring is also connected to the bottom 86 of a left base segment 82. The left coil spring returns the left support leg and left end cap to axial alignment with the left base segment in the absence of a deflecting force. The top 84 of the left base segment receives one end 100 of left elastic cord 96.

Figure 3:
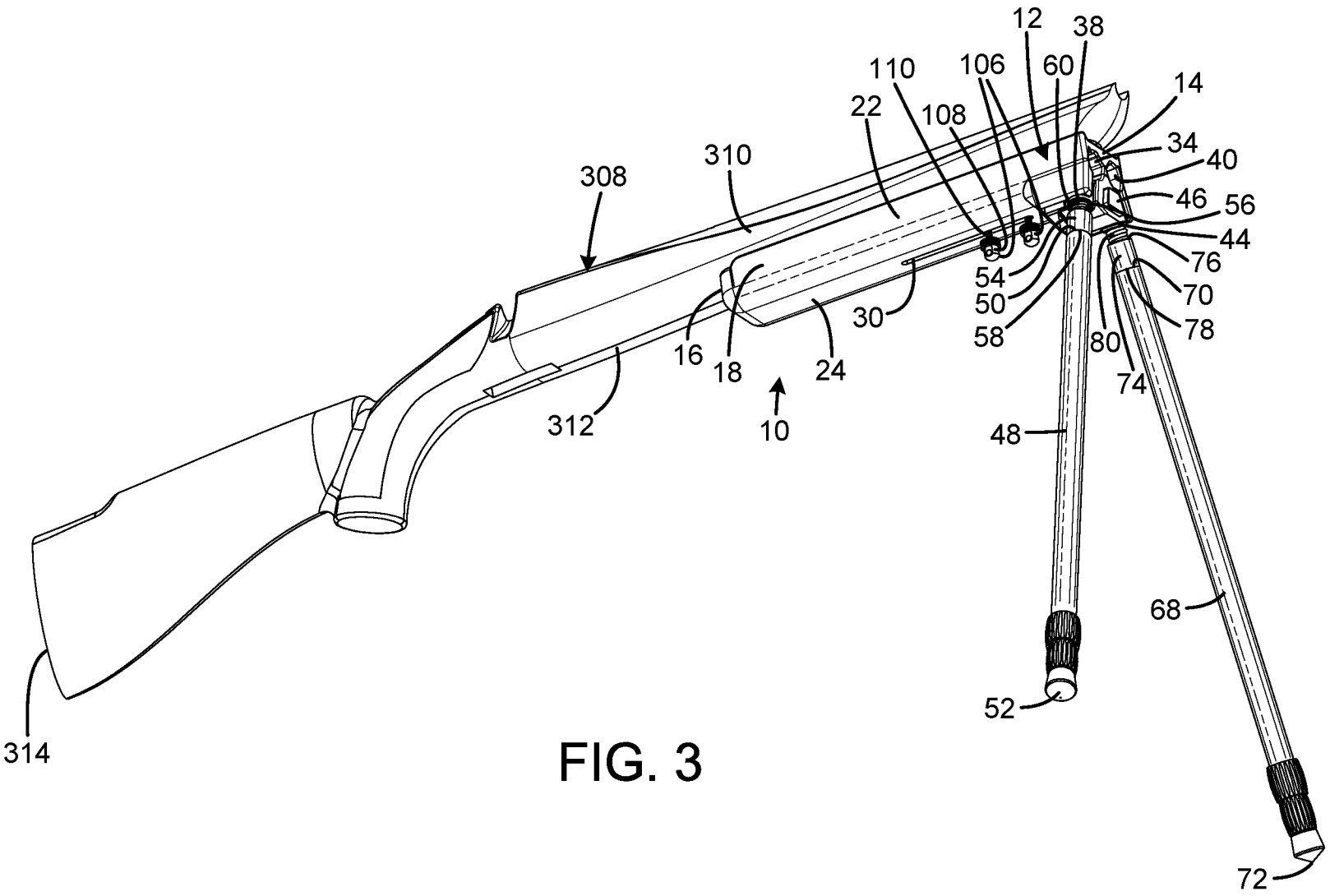
FIG. 3 is a bottom isometric view of the current embodiment of the bipod firearm support of FIG. 1 mounted on the forend of a rifle or shotgun with the support legs in an extended position.

In FIGS. 1 and 3, the right support leg 48 and left support leg 68 are depicted in an extended position with the right base segment 62 received within the right bore segment 38 and the left base segment 82 received within the left bore segment 44. In FIG. 1, the shooter is illustrated in the standing position with his left hand 304 using the left support leg 68 as a handle by grasping the left support leg. The bottom 52 of the right support leg 48 is braced against the shooter's body 302. The shooter has compensated for being in the standing position by tucking the bipod into his body to make an offhand shot. The bipod firearm support 10 can also be used to support a firearm with the shooter in a prone or seated position.

Figure 2:
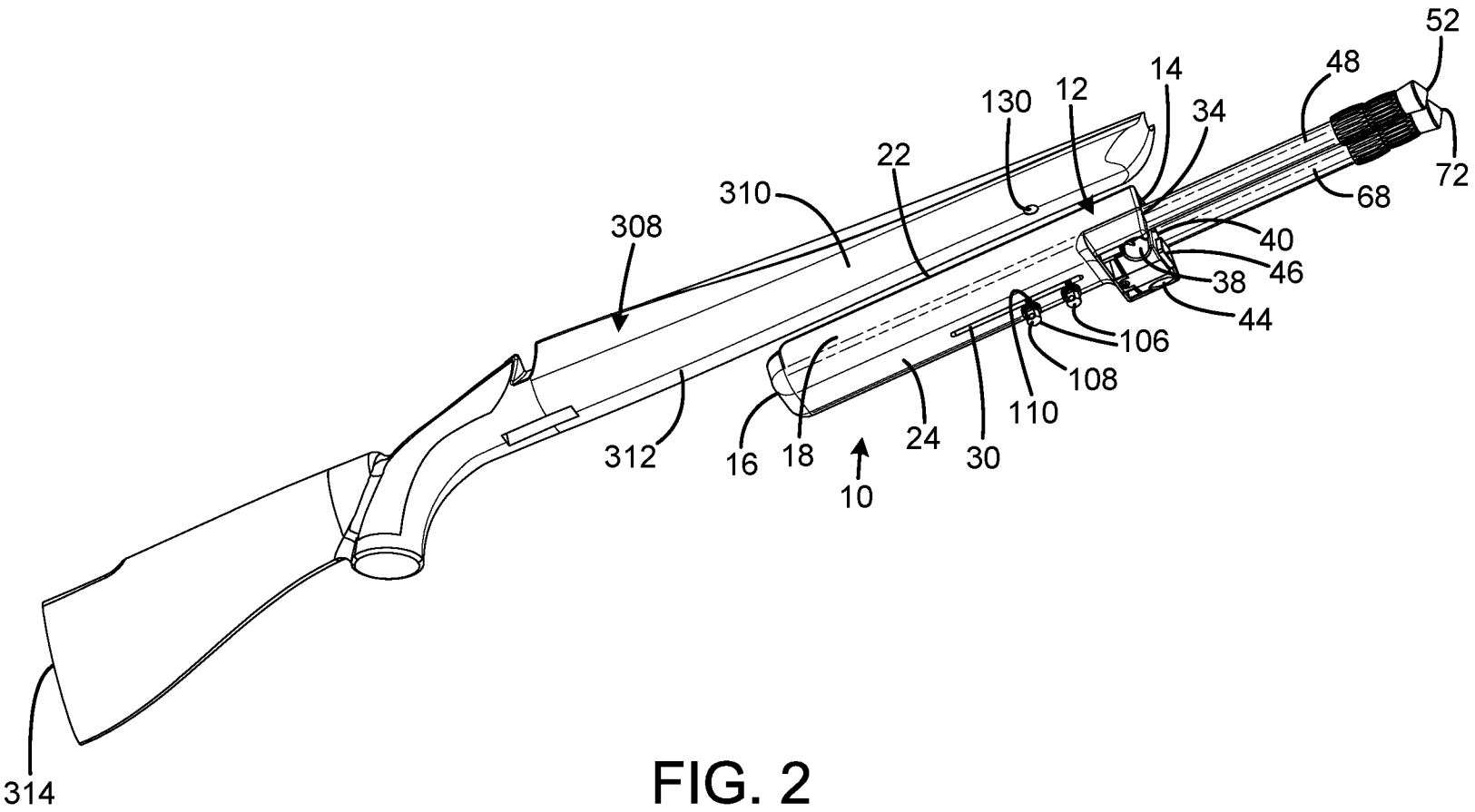
FIG. 2 is an exploded bottom isometric view of the current embodiment of the bipod firearm support of FIG. 1 illustrating how the current invention is mounted on the forend of a rifle, shotgun, or crossbow with the support legs in a stowed position.

In FIG. 2, the right support leg 48 and left support leg 68 are depicted in a stowed position with the right base segment 62, right coil spring 60, right end cap 54, and an upper portion of right support leg 48 received within the right bore 34 and the left base segment 82, left coil spring 80, left end cap 74, and an upper portion of left support leg 68 received within the left bore 40. The body 12 is shown detached from the bottom 312 of the forend 310 to expose threaded aperture 130 in the bottom of the forend. The head portions 108 of studs 106 are shown protruding from the bottom 24 of the body through a middle slot 30.

Figure 4:
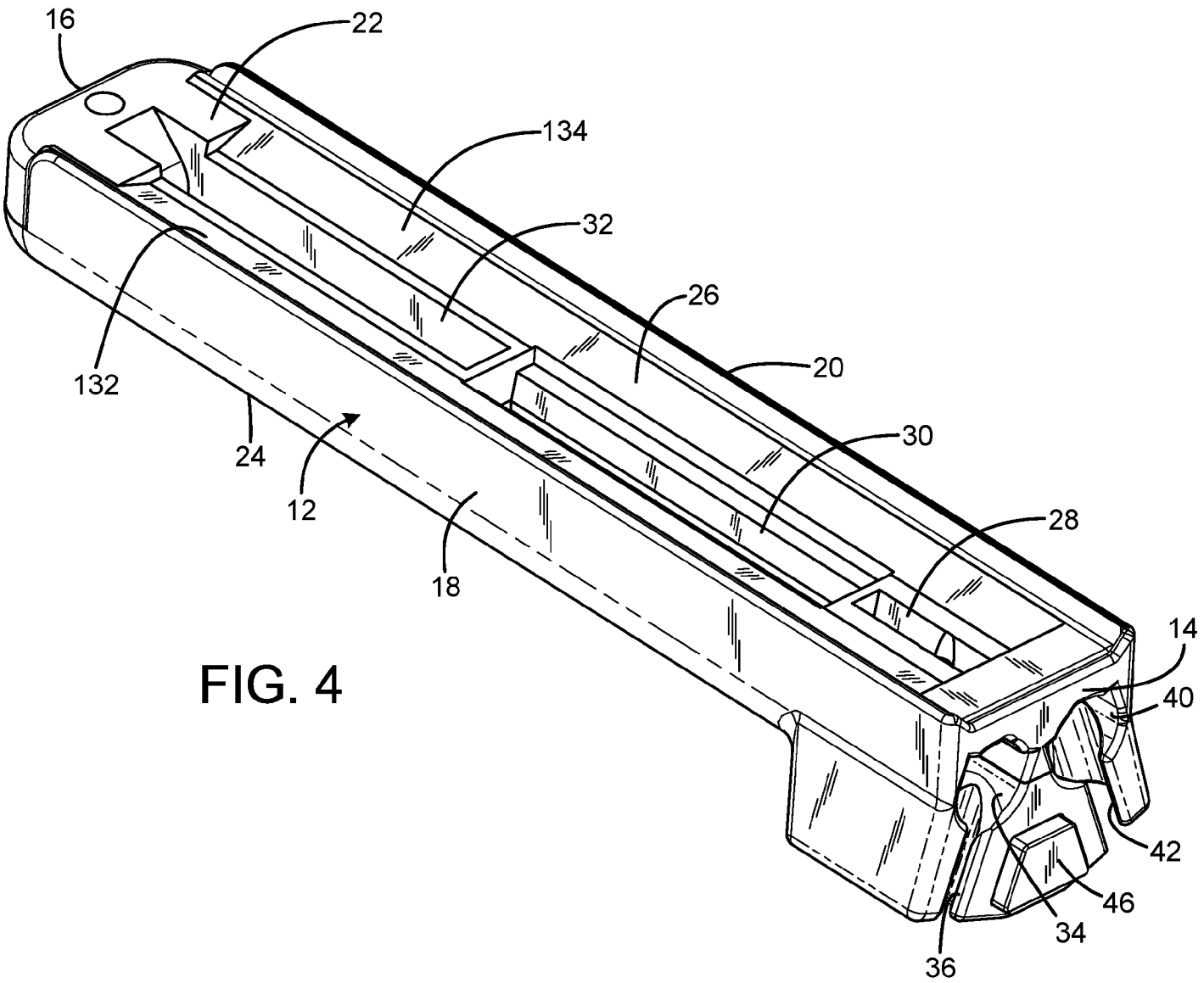
FIG. 4 is a top isometric view of the body of the bipod firearm support of FIG. 1.
Figure 5:
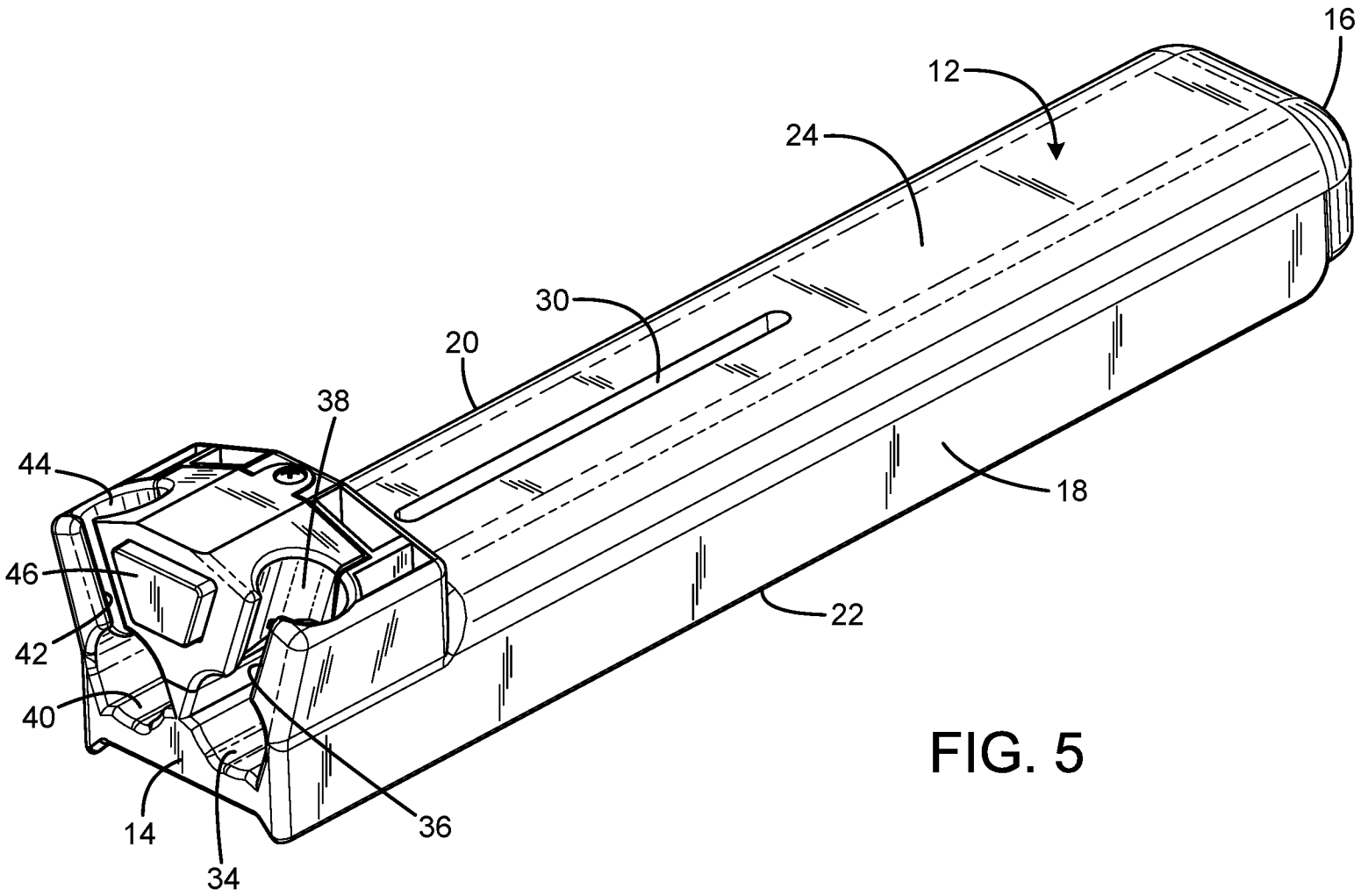
FIG. 5 is a bottom isometric view of the body of the bipod firearm support of FIG. 1.

In FIG. 4, the interior 26 of the body 12 is shown. The interior of the body defines a front slot 28, a middle slot 30, and a rear slot 32. As is shown in FIG. 5, only the middle slot penetrates the bottom 24 of the body. A right channel 132 and left channel 134 are defined on either side of the slots 28, 30, 32. The right and left channels are parallel to one another in the current embodiment and communicate with the right and left bores 34, 40, respectively. However, the channels can also be at an angle to one another in alternative embodiments.

Figure 6:
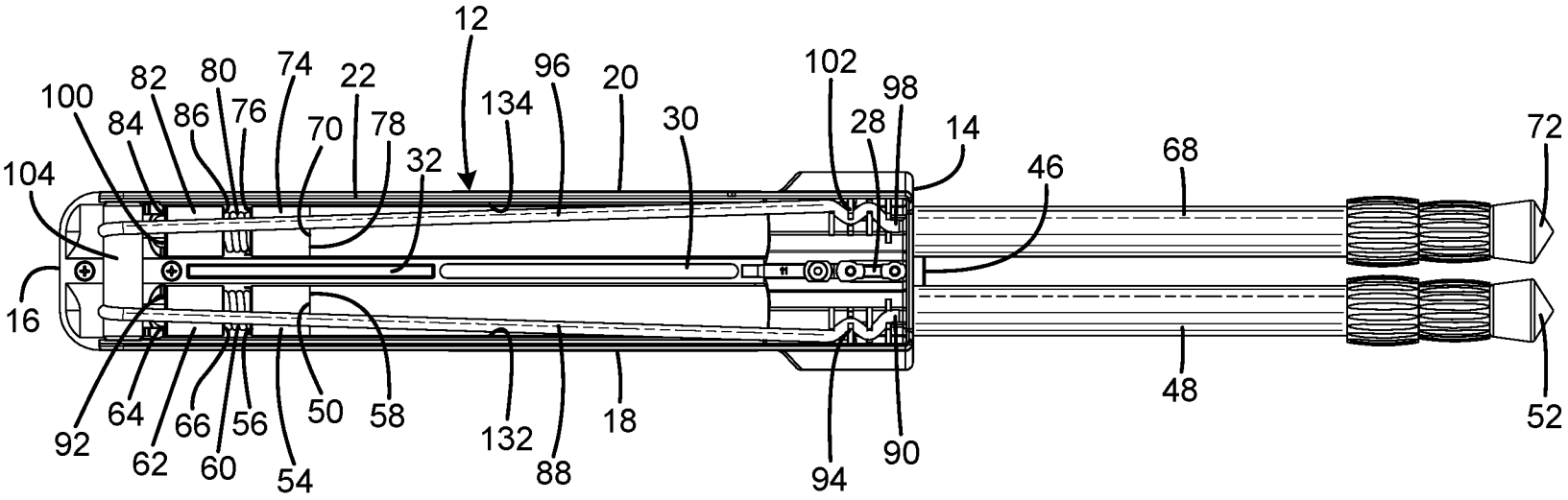
FIG. 6 is a top view of the body and support legs of the bipod firearm support of FIG. 1 with portions cutaway to illustrate the manner in which the opposed ends of the elastic cords are attached to the body and the support legs.
Figure 7:
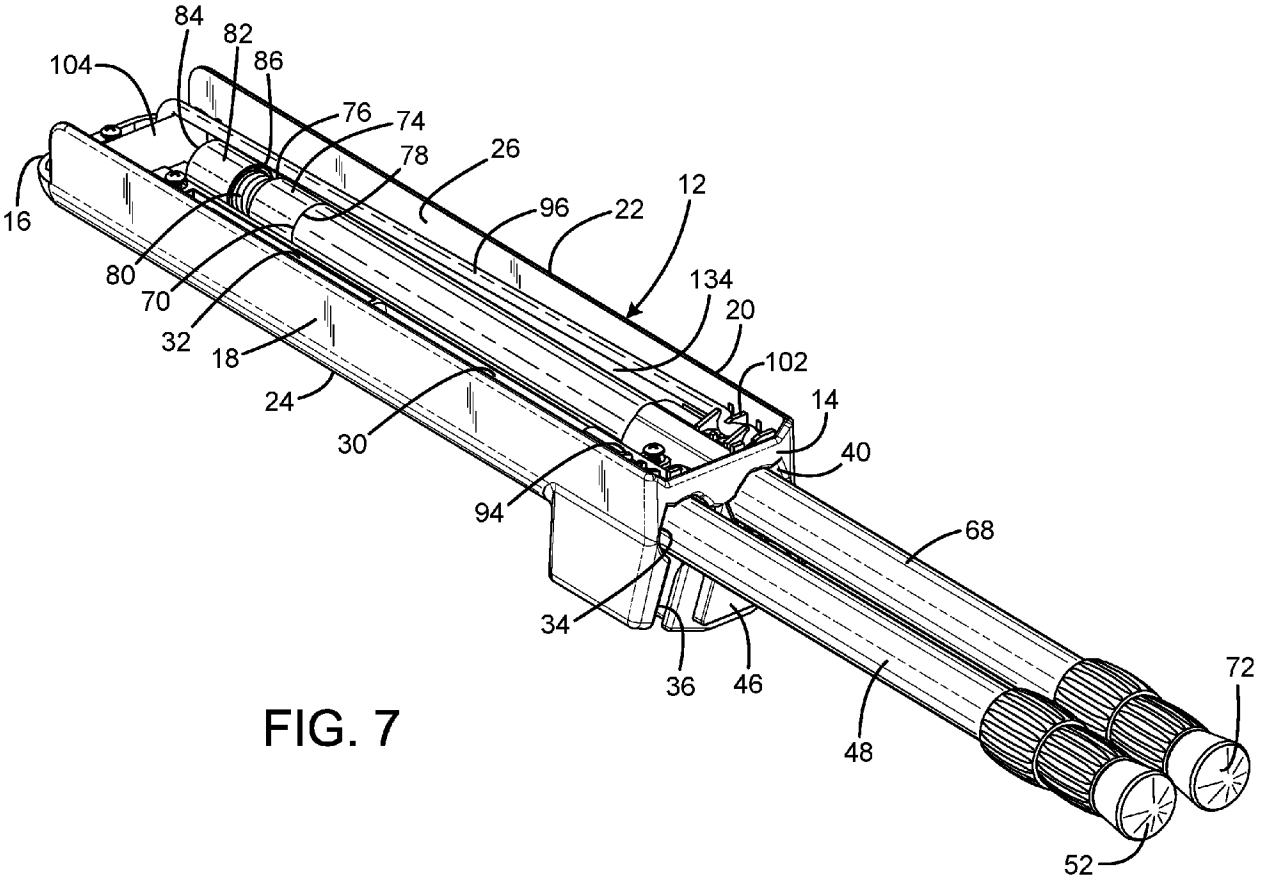
FIG. 7 is a top isometric view of the body and support legs of the bipod firearm support of FIG. 1 with portions cutaway to illustrate the manner in which the opposed ends of the elastic cords are attached to the body and the support legs.

In FIGS. 6 and 7, the interior 26 of the body 12 is shown with the right and left supporting legs 48, 68 in the stowed position. The right base segment 62, right coil spring 60, right end cap 54, and an upper portion of the right support leg are received within the right bore 34 and right channel 132. The left base segment 82, left coil spring 80, left end cap 74, and an upper portion of the left support leg are received within the left bore 40 and left channel 134. The top 64 of the right base segment receives one end 92 of right elastic cord 88. The opposed end 90 of the right elastic cord is attached to the front 14 of the body by right cord anchor 94. The top 84 of the left base segment receives one end 100 of left elastic cord 96. The opposed end 98 of the left elastic cord is attached to the front of the body by left cord anchor 102. Intermediate portions of the right and left elastic cords pass over a bearing 104 located at the rear 16 of the interior of the body. The right and left elastic cords double back over the bearing so the elastic cords can be stretched longer without being subjected to excessive strain that could result in failure. The right and left elastic cords serve to pull the left and right base segments into the left and right bores when the support legs are in the stowed position and into the left and right bore segments 38, 44 when the support legs are in the extended position. The elastic cords may be similar to those of U.S. Pat. No. 7,770,320 to Bartak), which is hereby incorporated by reference for all that it teaches therein.

Figure 8:
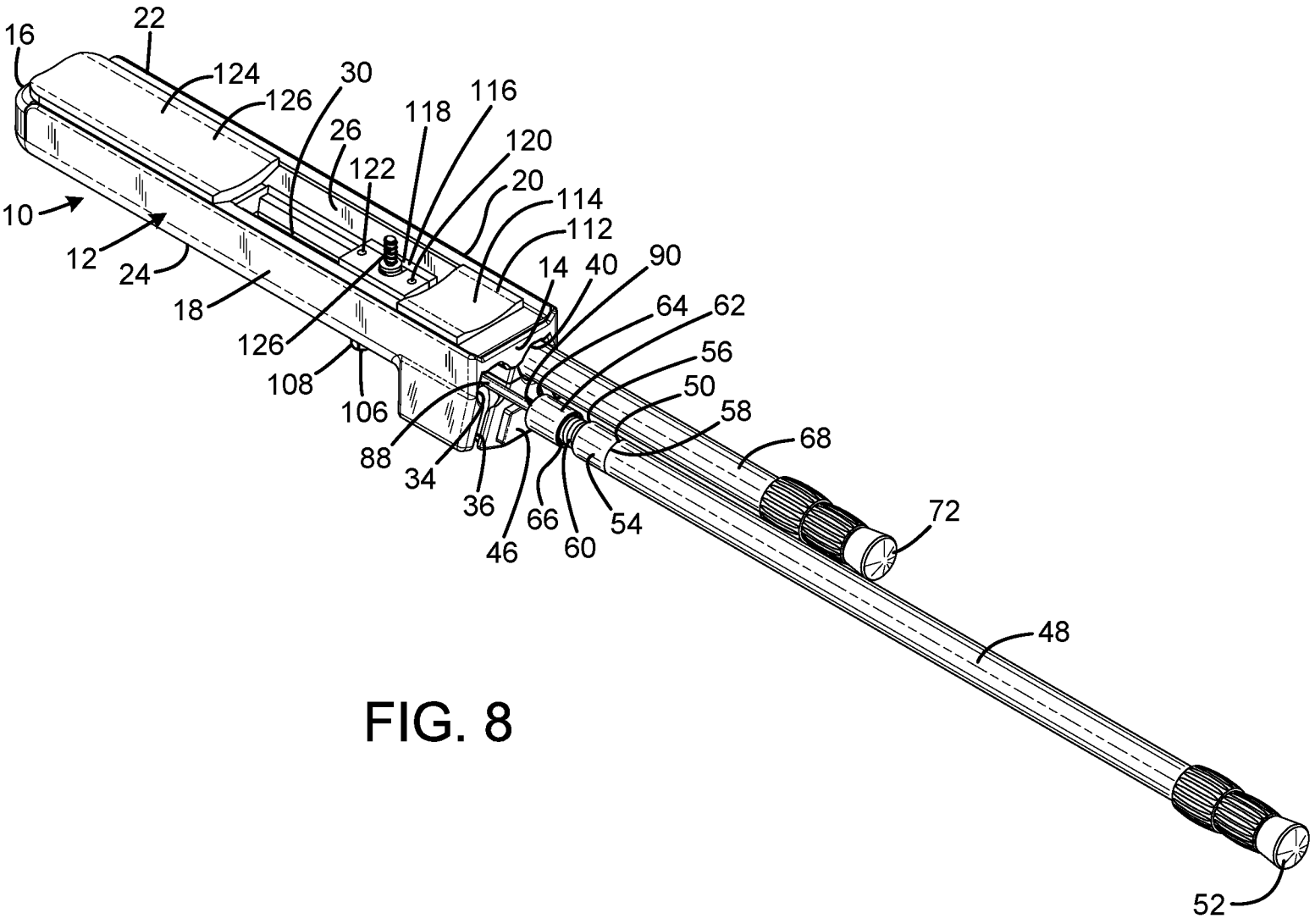
FIG. 8 is a top isometric view of the current embodiment of the bipod firearm support of FIG. 1 with one of the support legs completely removed from the corresponding bore.
Figure 9:
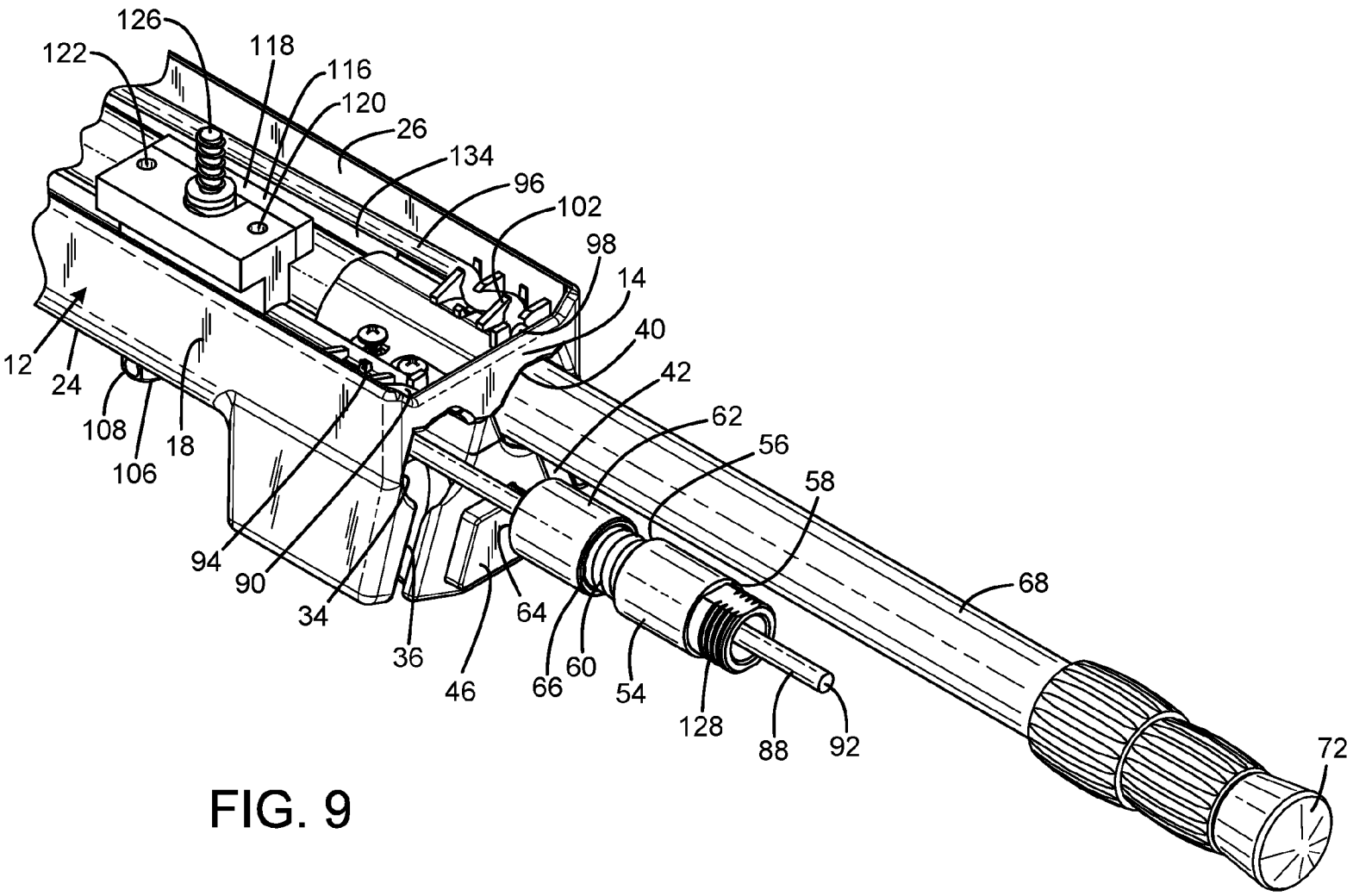
FIG. 9 is a partial enlarged top isometric view of the current embodiment of the bipod firearm support of FIG. 1 with portions cutaway to illustrate the manner in which the top of the support legs is threadedly connected to the bottom of the corresponding end cap.

In FIGS. 8 and 9, the right support leg 48 of the bipod firearm support 10 is shown in the process of being deployed from the stowed position into the extended position. More particularly, the shooter pulls the right support leg forward until the top 64 of the right base segment 62 is fully clear of the right bore 34. The shooter then pulls the right elastic cord 88 through the right slot 36, and then permits the right elastic cord to pull the right base segment 62 into the right bore segment 38. The identical procedure is repeated if desired to deploy the left support leg into the extended position. As can be appreciated from FIG. 9, the top 50 of the right support leg is attached to the bottom 58 of the right end 54 by epoxy or another suitable adhesive adhered to the undercut portion 128. The top 70 of the left support leg is similarly attached to the bottom 78 of the left end cap 74.

In the fully assembled state shown in FIG. 8, the top 22 of the body 12 of the bipod firearm support 10 has a front pad 112 attached to the interior 26 of the body utilizing front slot 28, a T block 116 attached to the interior of the body utilizing middle slot 30, and a rear pad 124 attached to the interior of the body utilizing rear slot 32. The top 114 of the forward pad and the top 126 of the rear pad are contoured to match the contour of the bottom 312 of the forend 310 of the stock 308 and prevent the bipod firearm support from marring the forend. The top 118 of the T block attaches to an existing or user-installed sling swivel screwed into the bottom of the forend of the stock via a threaded cross hole and a captured set screw 126 that runs through an existing threaded aperture 130 in the sling swivel. The T block also includes bores 120, 122 that receive the threaded portions 110 of the studs 106. The position of the T block and screw are longitudinally adjustable within the limits of travel imposed by the middle slot when the studs are loosened in order to enhance the compatibility of the bipod firearm support with stocks having a threaded aperture in different longitudinal positions on the forend. The studs then are tightened to secure the T block and screw in the desired position.

Figure 10:
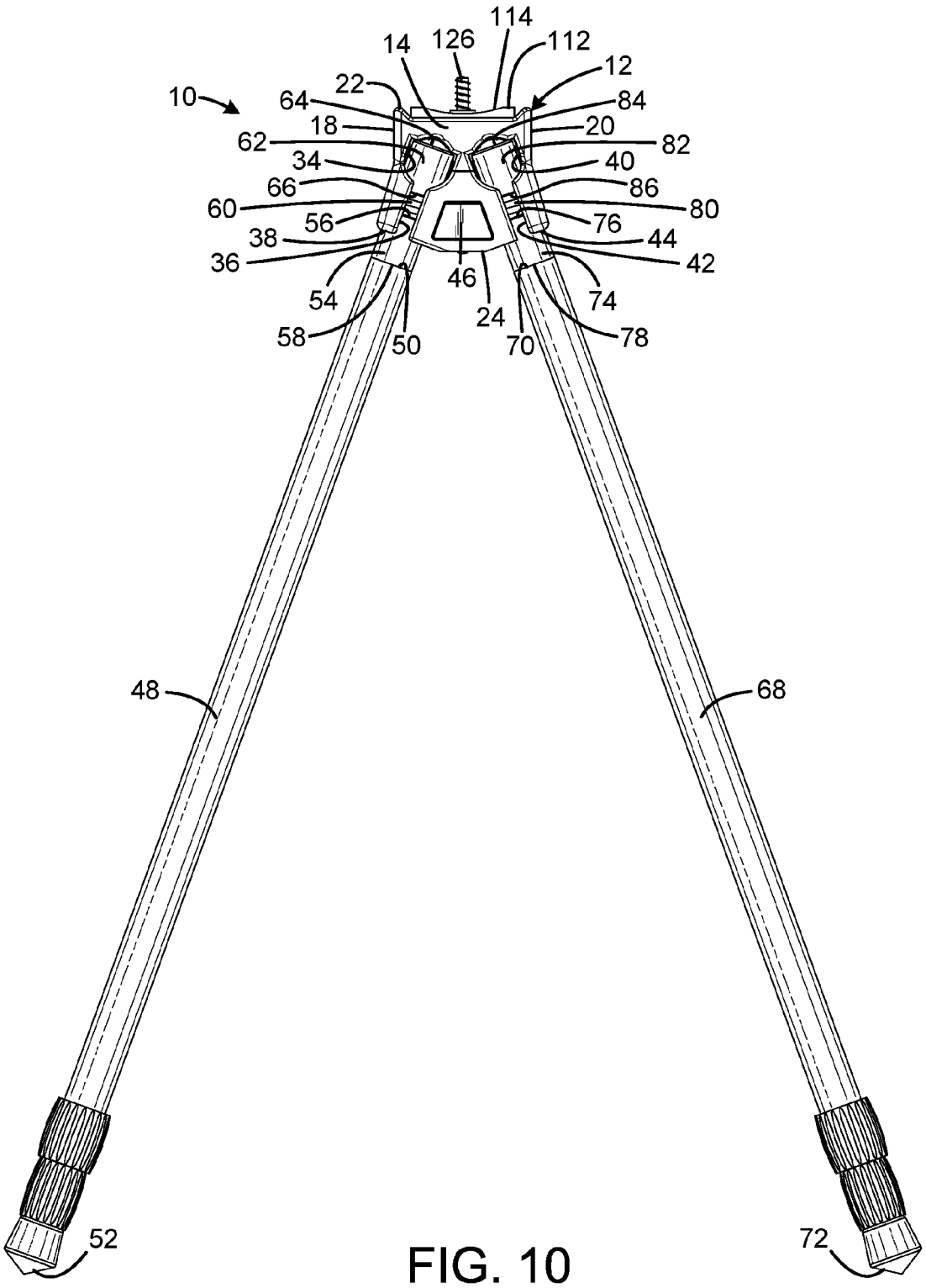
FIG. 10 is a front view of the current embodiment of the bipod firearm support of FIG. 1 illustrating the bipod firearm support being used in a level ground position.
Figure 11:
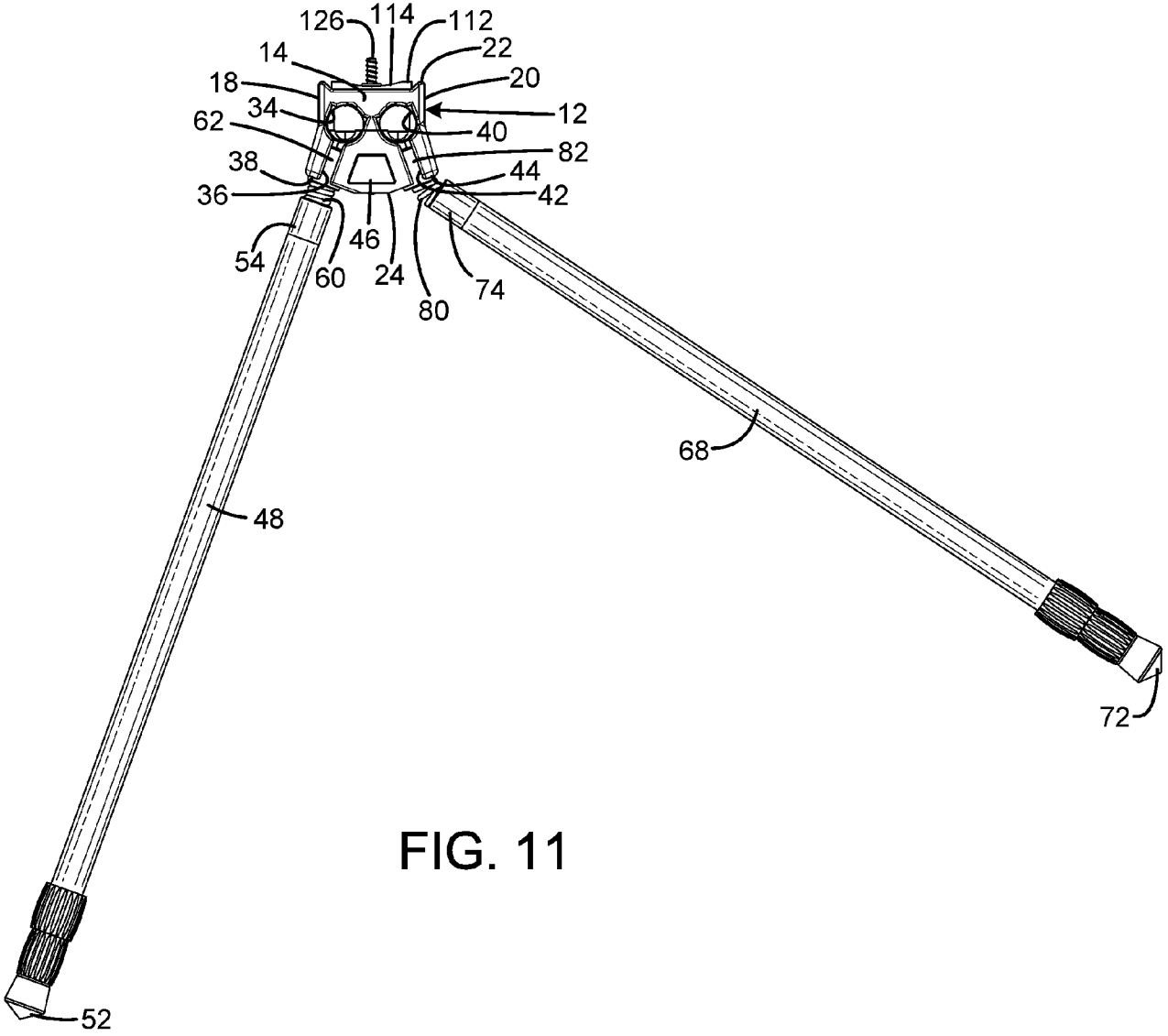
FIG. 11 is a front view of the current embodiment of the bipod firearm support of FIG. 1 illustrating the bipod firearm support being used in a side hill position.
Figure 12:
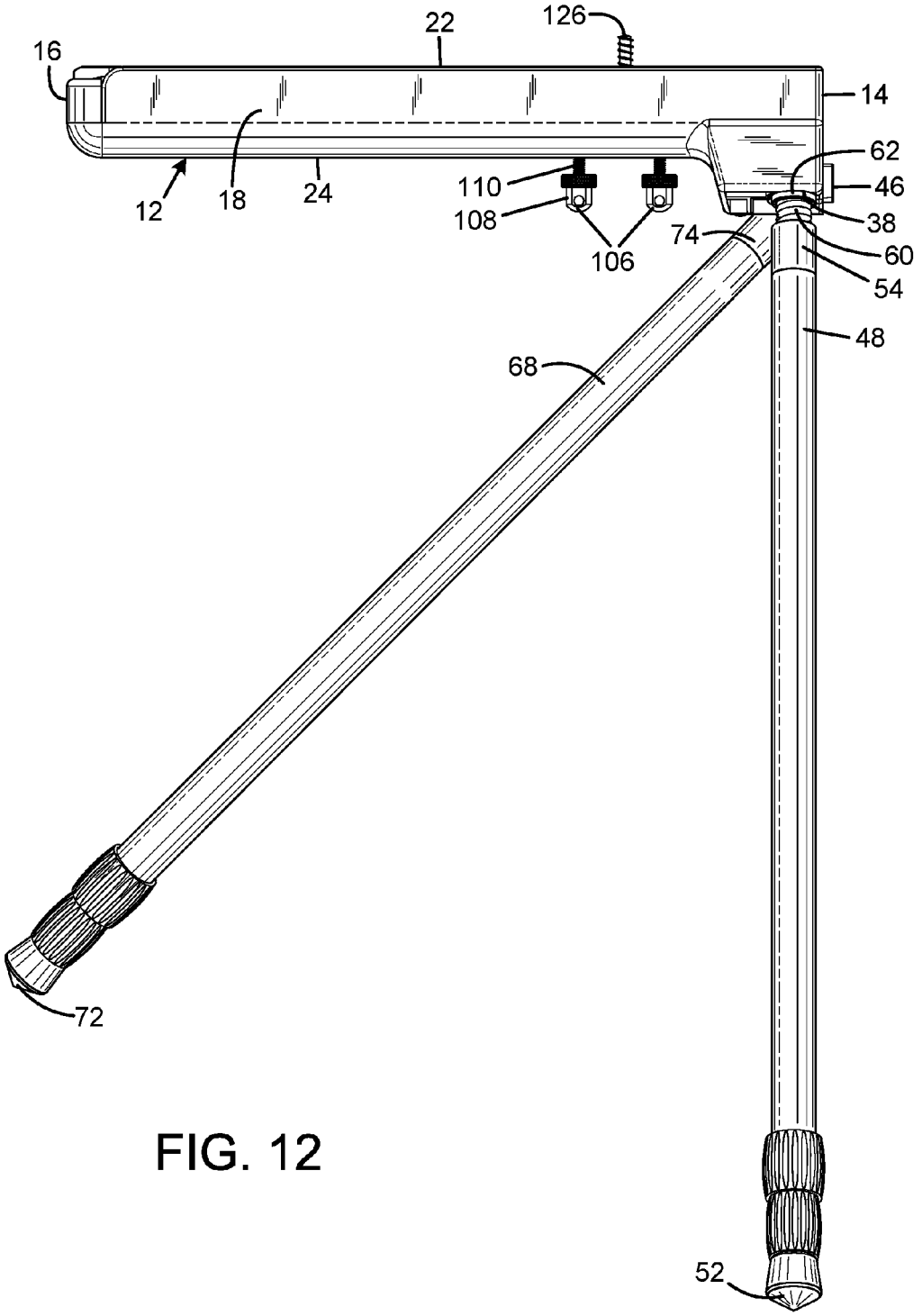
FIG. 12 is right side view of the current embodiment of the bipod firearm support of FIG. 1 illustrating the bipod firearm support being used in a different side hill position from that of FIG. 11.

FIGS. 10-12 illustrate the bipod firearm support 10 with the right and left support legs 48, 68 in the extended position adjusted for various types of terrain. The right and left support legs can assume two different axial positions within the bore segments 38, 44: a first flexible locked position with just a base segment 62, 82 of a support leg being closely received in a bore segment, and a second rigid unlocked position in which a support leg is inserted more deeply, and an end cap 54, 74 is also closely received in a bore segment. In FIG. 10, the right and left support legs are shown deployed in a rigid locked position suitable for level ground. The button 46 has been depressed to place the latches (not visible) internal to the right and left bore segments 38, 44 in the unlatched position. As a result, the right base segment 62, right coil spring 60, and the top 56 of the right end cap 54 are received within the right bore segment, and the left base segment 82, left coil spring 80, and the top 76 of left end cap 74 are received within the left bore segment. Therefore, the right and left coil springs are secured in axial alignment with respect to the base segments and end caps, and angular flexure of the right and left support legs 48, 68 is prevented.

In FIGS. 11 and 12, the right and left support legs 48, 68 are shown deployed in a flexible unlocked position suitable for use on the side of a hill. The button 46 has not been depressed, so the latches (not visible) internal to the right and left bore segments 38, 44 are in the latched position, which limits penetration of the support leg components into the bore segments. As a result, only the right base segment 62 is received within the right bore segment, and only the left base segment 82 is received within the left bore segment. Therefore, the right and left coil springs 60, 80 enable angular flexure of the right and left support legs in the presence of a deflecting force. In FIG. 11, the left support leg is flexed outwardly, and in FIG. 12, the left support leg is flexed rearwardly. In addition to the position shown in FIGS. 1 and 10-12, the right and left support legs can be used together like a monopod, can be flexed outwardly or pushed forward or pulled back to lower the muzzle of the supported firearm, can be lifted to raise the muzzle of the supported firearm, can be dragged over obstacles by the supported firearm while continuing to support the firearm, or can stand the firearm up at rest like a tripod.

Figure 13:
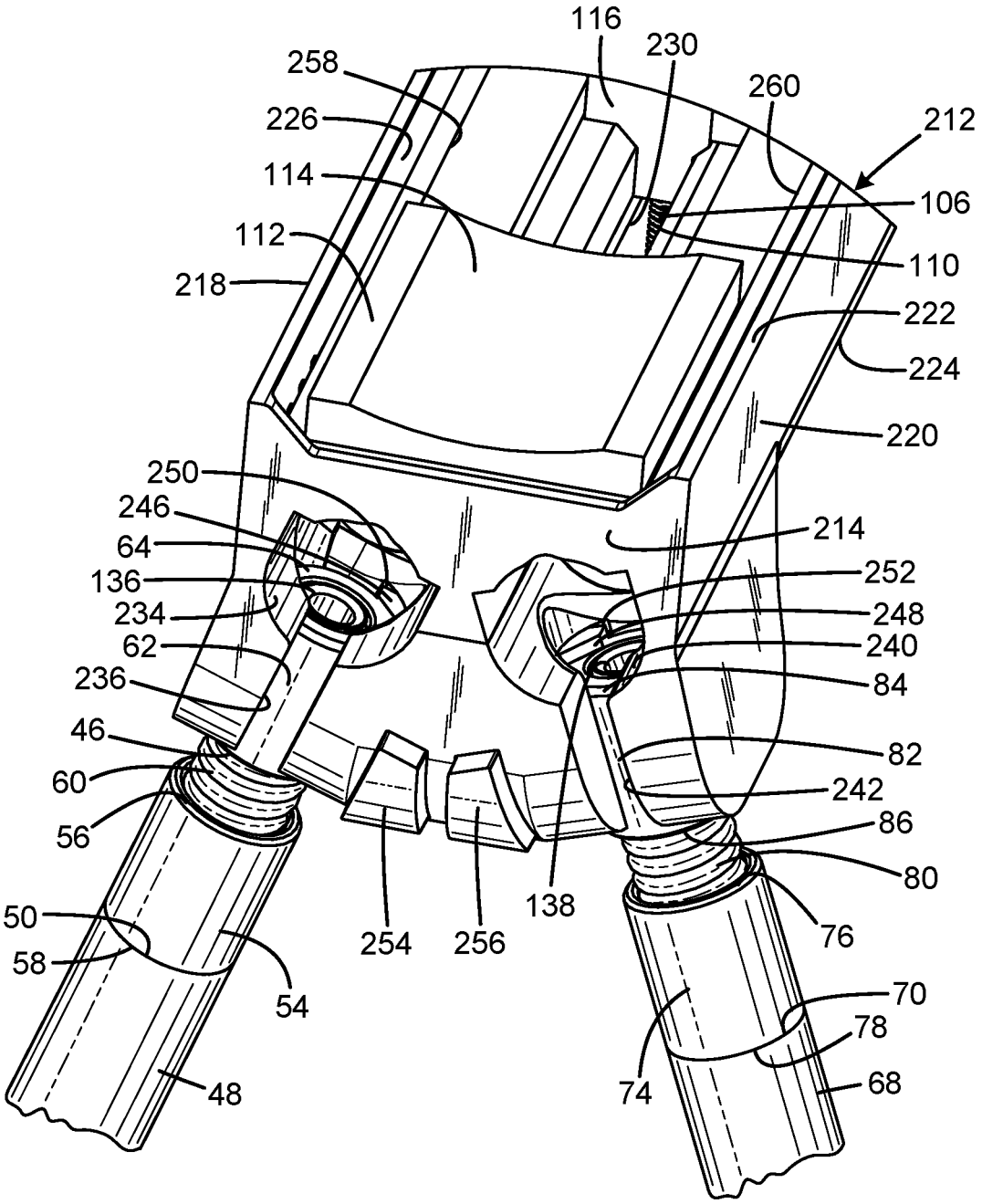
FIG. 13 is a partial enlarged front isometric view of an alternative embodiment of the body of the bipod firearm support of the current invention with the elastic cords removed.
Figure 14:
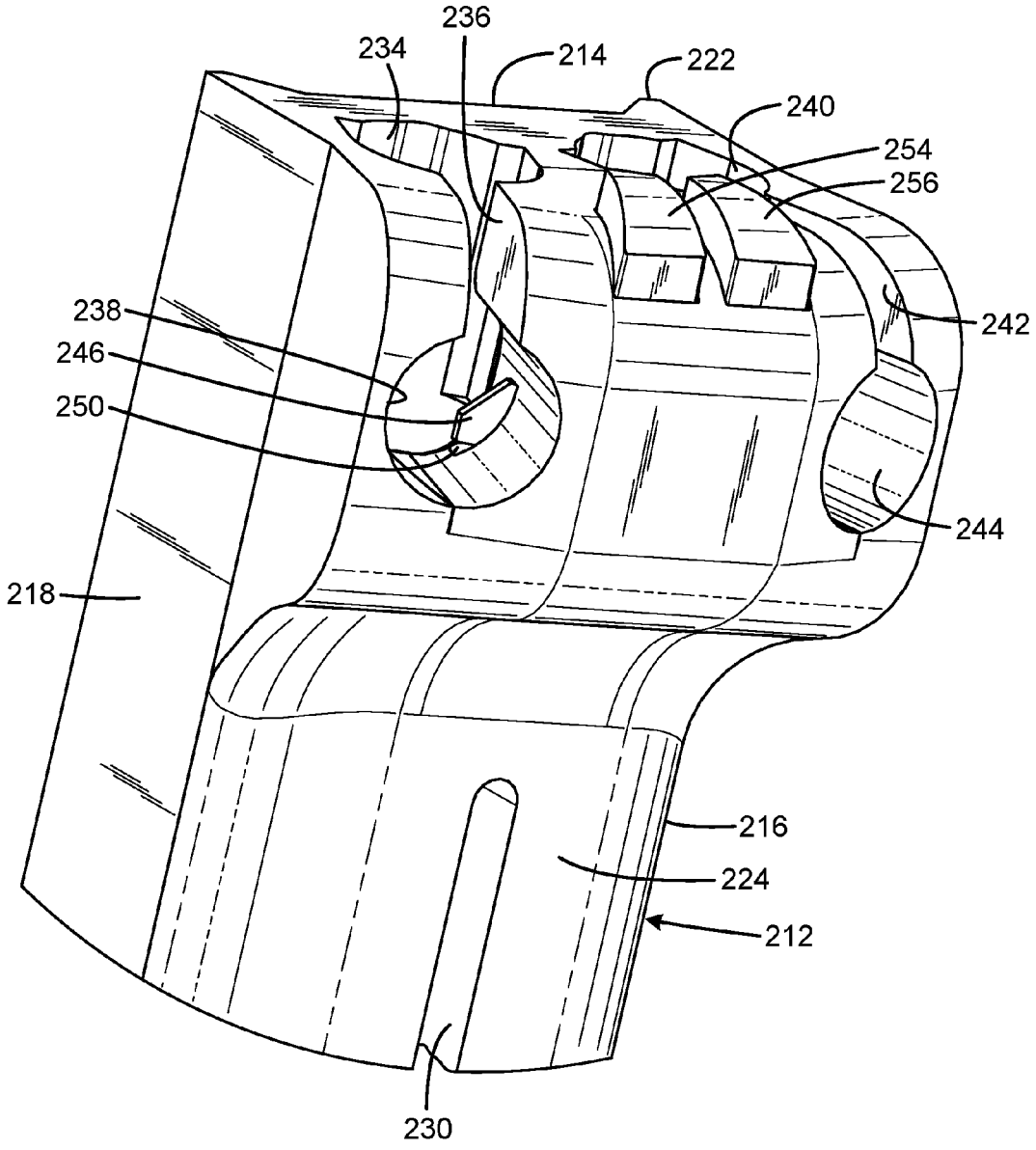
FIG. 14 is a partial enlarged bottom isometric view of the alternative embodiment of the body of the bipod firearm support of the current invention with the latches in the latched position.
Figure 15:
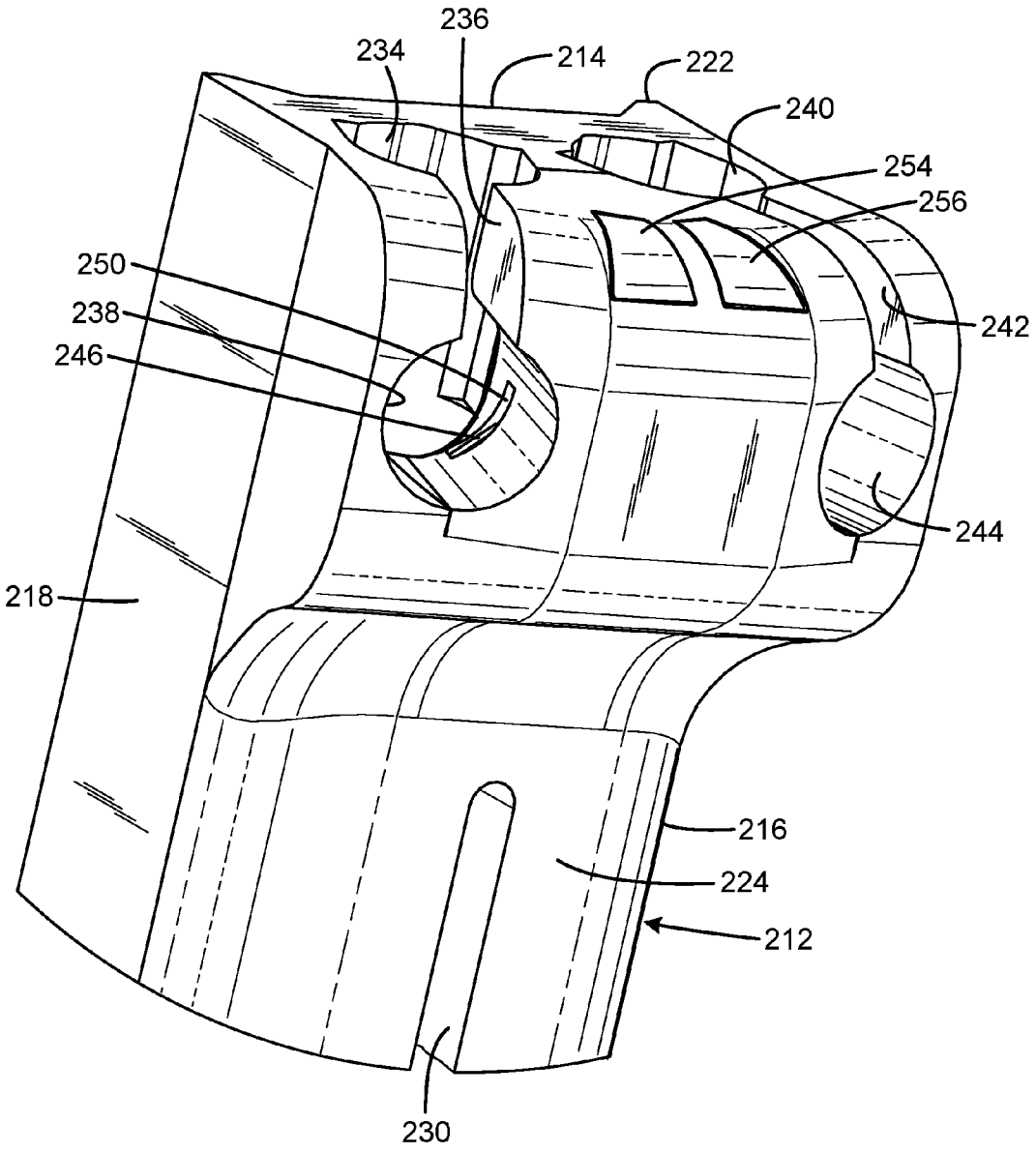
FIG. 15 is a partial enlarged bottom isometric view of the alternative embodiment of the body of the bipod firearm support of the current invention with the latches in the unlatched position.

FIGS. 13-15 illustrate an alternative embodiment of the body 212 the improved bipod firearm support of the present invention. More particularly, the body 212 uses the same internal right and left latches 246, 248 protruding from right and left latch slots 250, 252 as the body 12. FIGS. 13 and 14 show the right and left latches in the latched position with the right and left buttons 254, 256 not actuated, and FIG. 15 shows the right and left buttons actuated to place the right and left latches in the unlatched position. The primary difference between the body 212 and the body 12 is that the button 46 of the body 12, which latches and unlatches both the right and left latches simultaneously, is replaced by separate right and left buttons in the alternative embodiment. The separate right and left buttons enable individual control over the position of the right and left latches. This capability permits one support leg to be placed in the rigid locked condition and one support leg to be placed in the flexible unlocked condition if desired, which is not possible using body 12.

The body 212 has a front 214, rear (not visible), right side 218, left side 220, top 222, bottom 224, and interior 226. The front of the body defines a right bore 234 and a left bore 240 that are parallel to one another in the current embodiment. However, the right and left bore can also be at an angle to one another in alternative embodiments to accommodate alternative support leg designs and/or to avoid the bore of the attached firearm. A right bore segment 238 and a left bore segment 244 are in communication with, perpendicular to, and angularly offset with respect to their respective bores in the current embodiment. However, the bore segments can also be at angles other than 90° to their respective bores in alternative embodiments. A right slot 236 and a left slot 242 are in communication with their respective bores and bore segments. The interior of the body defines a front slot (not visible), a middle slot 230, a rear slot (not visible), right and left channels 258, 260, a bearing (not visible), and right and left anchors (not visible). The body 212 also has changes to the contours relative to the body 12 to improve moldability in the current embodiment. All of the other components of the bipod firearm support 10 are suitable for use with the body 212 to assemble a complete bipod firearm support. The right and left elastic cords 88, 96 have been omitted so central bores 136, 138 in the tops 64, 84 of the right and left base segment 62, 82 that receive ends 92, 100 of the right and left elastic cords are visible.

In the current embodiment, the length of the right and left elastic cords exposed from the right and left base segments is 11⅜ inch. The total length of the collapsed support legs is 17⅝ inch including the flexible member for the longer length version and 13½ inch including the flexible member for the shorter length version. The combined length of the bores and channels is 9½ inch.

While current embodiments of a bipod firearm support have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a single button activating two latches simultaneously and two buttons activating two latches independently have been described, it should be appreciated that the invention can also include a single button activating a single latch that extends into both bore segments, or a single button activating two separate latches that can independently assume the latched and unlatched positions. Furthermore, a rigid cord with a tension spring or rubber can be used instead of the elastic cord described. In addition, the support legs may have interchangeable feet to adapt the support legs to a variety of terrain. Finally, the bipod firearm support of the invention could be an integral portion of the stock or forearm of the firearm in alternative embodiments.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bipod comprising:

a body defining a first bore and a second bore;

a first offset bore segment associated with the first bore, and angularly offset with respect to the first bore;

a second offset bore segment associated with the second bore, and angularly offset with respect to the second bore;

a first elongated leg adapted to be closely and removably received in the first bore for stowage;

a second elongated leg closely and removably received in the second bore for stowage;

each of the first and second legs having a base segment sized to the associated offset bore segment and closely received in the associated offset bore segment for deployment; and each of the first and second legs having an elongated leg portion connected to the base segment by way of a connection facility that enables angular flexure of each elongated leg portion with respect to the base segment.

2. The bipod of claim 1 wherein the connection facility is a coil spring.

3. The bipod of claim 1 wherein the connection facility is a biasing element operable to return the leg portion to axial alignment with the base portion in the absence of a deflecting force.

4. The bipod of claim 1 wherein the connection facility is a cylindrical member having a diameter substantially the same as that of the leg portion.

5. The bipod of claim 1 including an elastic connector connecting each leg to the body.

6. The bipod of claim 5 wherein each elastic connector has a first end connected to the leg, an intermediate portion passing over a bearing at a rear portion of the body, and a second end connected to the body forward of the bearing.

7. The bipod of claim 1 wherein the body defines a slot communicating with each bore.

8. The bipod of claim 1 wherein each offset bore segment is perpendicular to each associated bore.

9. The bipod of claim 1 wherein the bores are parallel to each other.

10. The bipod of claim 1 wherein each of the elongated leg portions has an adjustable length.

11. The bipod of claim 10 wherein each of the elongated leg portions has a plurality of elongated segments telescopically interacting with each other.

12. The bipod of claim 1 wherein each of the elongated leg portions has two different axial positions, a first position with just the base segment of an elongated leg portion being closely received in an offset bore segment, and a second position in which the elongated leg portion is inserted more deeply into the offset bore segment, and the connection facility and a portion of the elongated leg portion are closely received in the offset bore segment.

* * * * *